US005241729A

United States Patent [19]

MacKirdy

[11] Patent Number: 5,241,729

[45] Date of Patent: Sep. 7, 1993

[54] BURIAL CASKET STATIONERY HARDWARE BAR SECUREMENT

[75] Inventor: William T. MacKirdy, Scott Run, Pa.

[73] Assignee: Casket Shells, Inc., Eynon, Pa.

[21] Appl. No.: 895,776

[22] Filed: Jun. 9, 1992

[51] Int. Cl.[5] ..... A61G 17/00

[52] U.S. Cl. ..... 27/2; 27/10; 16/110 R; 16/112; 16/111 R

[58] Field of Search ..... 27/2-10; 16/110 R, 110.5, 111 R, 112

[56] References Cited

U.S. PATENT DOCUMENTS 2,395,443 1/1946 Zaiser ..... 16/112

4,930,197 6/1990 McClive ..... 27/2

*Primary Examiner*—Richard E. Chilcot, Jr.

*Attorney, Agent, or Firm*—Kane, Dalsimer, Sullivan, Kurucz, Levy, Eisele and Richad

[57] ABSTRACT

A casket is provided with a stationary hardware system for coupling bars to the sides of the casket such that no load is carried by decorative hardware when lifting the casket with the bars. Each system includes a block for attachment to the side of the casket and a clamp for embracing the bar. Camming surfaces on the block cooperate with surfaces on the clamp to tighten the grip of the clamp about the bar upon tightening a bolt and nut assembly that couples the clamp and block to the casket side.

15 Claims, 3 Drawing Sheets

BURIAL CASKET STATIONERY HARDWARE BAR SECUREMENT

BACKGROUND OF THE INVENTION

The bars or handles on a burial casket in addition to serving a decorative purpose, are utilized during a burial service by pall bearers to lift the casket and transport it to the desired location either during the pre-burial service or to the place of burial. In this regard, the casket, with the body of the deceased, may weigh several hundred pounds, so that the bars may prove necessary to assist the pall bearers in moving the casket. These bars normally are held by a series of arms or brackets connected to the sidewalls of the casket. Burial casket bars of this type are generally a straight tubular member which extends from near one end to near the other end of each side of the burial casket. The arms which constitute the hardware for the bar could either be stationery or swing bar hardware. Typical prior art swing bar hardware is disclosed in U.S. Pat. Nos. 3,204,286 and 4,615,085.

As an example, stationery hardware for bars have assumed the form shown in FIGS. 1 and 2 in which lugs and corners, with anywhere from two to four sheet metal screws, attach each part to the casket. Normally anywhere from 24 to 48 screws are deployed per casket for such hardware. Slots in the lugs and corners serve to support the bar. In this prior arrangement, the corners, lugs and sheet metal screws support and bear the load.

Prior art hardware systems of the foregoing type have proven to be of questionable safety, utilize a large number of parts, labor intensive and require relatively expensive and costly tooling. In such system, hardware in the form of lugs and corners form a supporting function as well as provide the desired ornamental and aesthetic affects on the exterior of the casket.

SUMMARY OF THE INVENTION

A principle object of the present invention is to provide a stationery hardware bar securement system that is safer, utilizes less parts and requires less costly tooling while permitting the hardware providing the decorative function to be interchangeable to satisfy customer needs and desires.

These and other objects of the invention are achieved by utilizing a one bolt system to secure non decorative stationery bar hardware to caskets. In this system, the bars, hardware and the bolts are the major load bearing components. Decorative pieces and decorative, non load bearing lugs on the corners, on the other hand, become ornamental parts that could simply be made to snap on and off so that other styles could be used interchangeably with the same hardware.

BRIEF DESCRIPTION OF THE DRAWINGS

The objects and advantage of the present invention will become apparent from the following detailed description of the preferred embodiment which is to be taken in connection with the accompanying drawings in which like numerals designate like parts, and in which.

DETAILED DESCRIPTION OF THE PREFERRED EMBODIMENTS OF THE INVENTION

Figure 1:
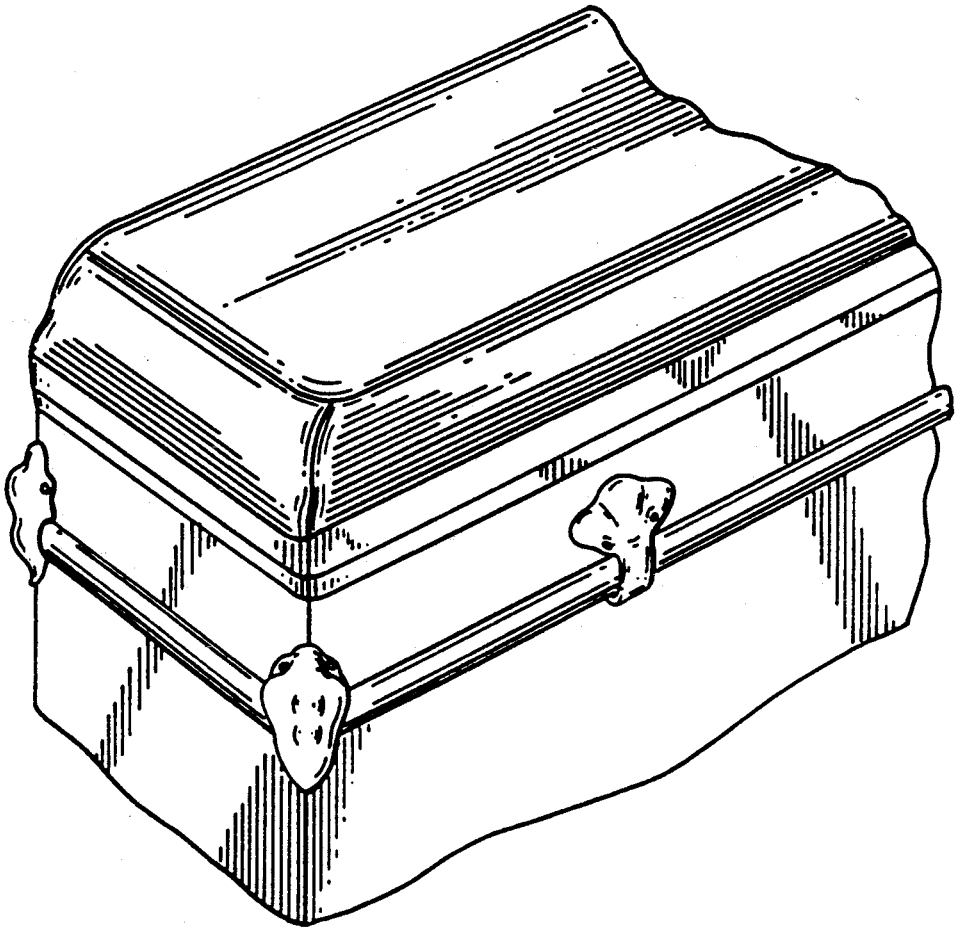
FIG. 1 PRIOR ART
FIG. 1 is a fragmentary perspective view of a casket utilizing a prior art stationery hardware bar system.
Figure 2:
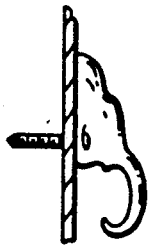
FIG. 2 PRIOR ART
FIG. 2 is a fragmentary sectional view of the supporting lug for the bar.
Figure 3:
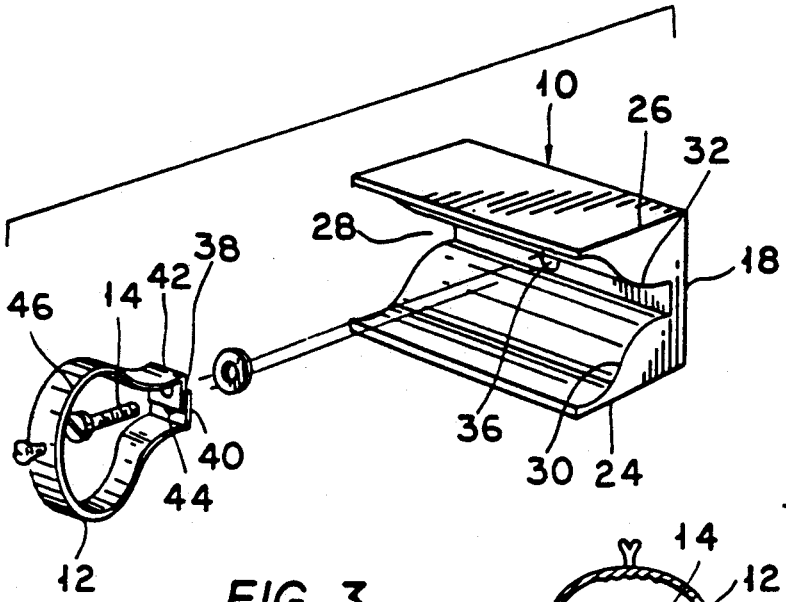
FIG. 3 is an exploded perspective view of the bar supporting hardware of the present invention for a stationery bar.
Figure 4:
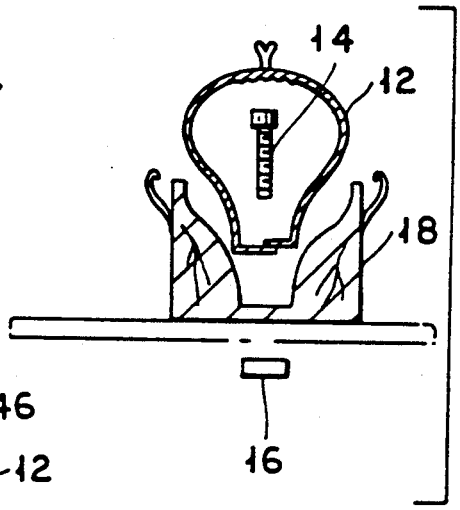
FIG. 4 is a cross-sectional view of the supporting hardware prior to the tightening of the bolt.
Figure 5:
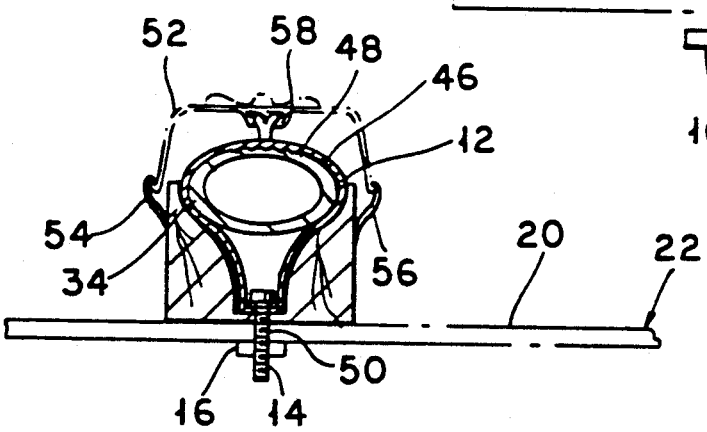
FIG. 5 is a cross-sectional view of the supporting hardware assembled by tightening the bolt and connected to the sidewall of a casket shown in phantom with the outer decorative hardware also shown in phantom.
Figure 6:
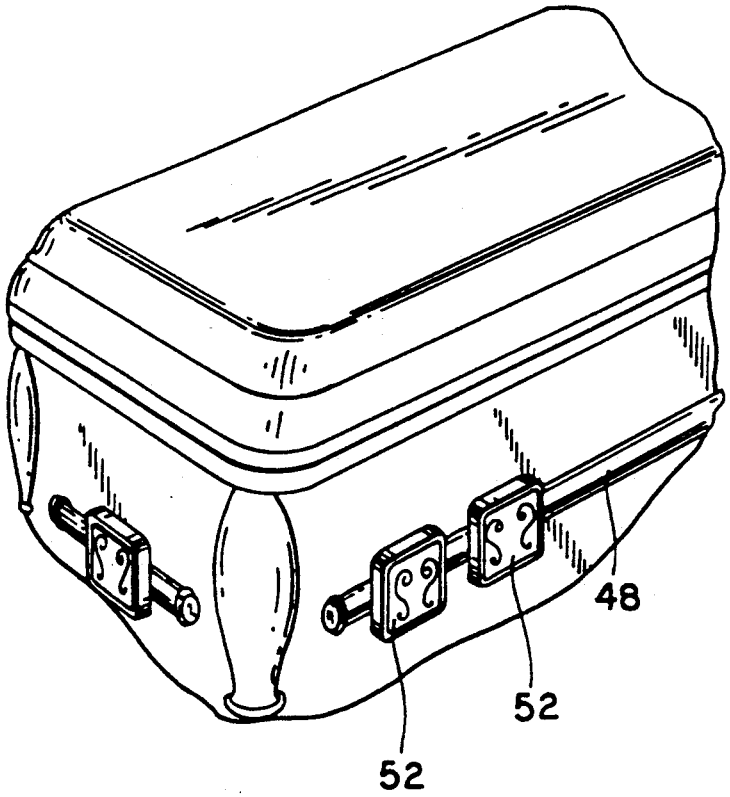
FIG. 6 is a fragmentary perspective view of a casket with the supporting hardware in place and decorative hardware associated therewith and at the casket corners covering the ends of the bars.

Referring initially to FIG. 3, the hardware providing the support and connection for the bar to the casket sidewalls will include at least two hardware assemblies each having a mounting block 10 and a clamp 12 and bolt 14 with mating nut 16. The block 10 can be formed either of wood, plastic or metal and will include a relatively flat base 18 for resting against the sidewall 20 of the casket 22. From the base 18 extends outwardly two upstanding legs or arms 24 and 26 forming an interior channel 28 therebetween. As will become evident shortly the leg surfaces forming the channel 28, include camming faces 30 and 32 on the respective legs 24 and 26 which cooperate in tightening the strap 12 about the bar 34. The block will also include a hole 36 to accommodate the bolt 14.

The clamp is preferably formed of sheet metal but may be also formed of a suitable plastic material and is provided with split ends 38 and 40 having respective holes 42 and 44 for receiving bolt 14. The clamp is formed into a loop 46 in the general configuration of the bar or handle 34. The interior face of the loop 46 may be provided with serration or other surface irregularities 48 to enhance the gripping action against the exterior of the bar 34 or may possess other surface configurations that mate with the external shape or configuration of the bar. The size and shape of the loop 46 is selected so that when the loop engages with the cam surfaces 30 and 32, the bolt 14 the gripping action of the strap about the handle will increase with the tightening of bolt 14.

In assembling the stationery bar supporting hardware system and components to the casket sidewall 20 the following procedure may be followed. At least two such systems are used for each bar placed along the exterior of the side 20 of the casket 22. The clamp 12 is moved into position within the block 10 and the bolt 14 is extended through holes 42 and 44 in clamp ends 38 and 40, respectively, and then through opening 36 in the block 10 and ultimately through the hole 50 in the sidewall 20 of the casket 22. The nut 16 is then applied to the free end of the bolt 14 located internally of the casket 22. At this juncture or prior to assembling the block and clamp to the casket sidewall 20, the bar 48 is placed within the loop 46 of the clamp 12. The configuration and dimensioning of the clamp relative to the channel 28 and particularly the camming surfaces 30 and 32 are such that the more the bolt 14 is tightened by means of the nut 16, the firmer is the grip and engagement of the internal surfaces of the loop 46 of the clamp 12 about the bar 34. As explained previously, this gripping action is enhanced by serration or other roughened surfaces 48 on the inner surfaces of the loop 46.

Thus, the bar hardware that holds the bar 34 stationery and supports it and assumes all of the support and load bearing afford when the bar is deployed in lifting the casket has been disclosed.

In order to complete the outer decorative effects that normally accompanies the bar 34, decorative hardware or pieces may now be applied to conceal or mask the supporting components, namely block 10 and clamp 12 and also the corners of the casket 22 and the free ends of the bar 34. This hardware, in as much as it no longer needs to be load supporting, may be made of relatively thin, less costly materials of plastic or sheet metal that is suitably configured to provide the desired ornamental and aesthetic effects. This ornamental hardware associated with the block 10 and clamp 1 may simply be clamped or clipped in place or be connected in any other conventional manner. One suggested system would be to have the decorative hardware piece 52 couple or mate with spring arms 54 and 56 which extend from the block 10 be in any suitable manner as by any suitable fastening needs, as well as the use of a barb or clip 58 either extending integrally from the exterior of the clamp 12 or suitably coupled therewith by any conventional fastening means. Similarly the corner decorative hardware 60 be placed over the each end of the bar 34 and connected thereto or to the sidewalls and endwalls of the casket 22 in any suitable manner.

Thus, the several aforenoted objects and advantages are most effectively attained. Although several somewhat preferred embodiment of the invention has been disclosed and described in detail herein, it should be understood that this invention is in no sense limited thereby and its scope is to be determined by that of the appended claims.

What is claimed is:

1. A stationary bar hardware system for a casket comprising in combination:

a block for attachment to the side of a casket; a clamp having an opening for receiving a bar; coupling means for coupling upon actuation the clamp to the block and the block in turn to the side of a casket; and the clamp and block providing tightening means defined by interranging surfaces of the clamp and block to tighten the clamp above the bar upon actuation of the coupling means.

2. The invention in accordance with claim 1 wherein the block, clamp and coupling means cooperate in providing the complete support for the bar which is accordingly able to bear the weight of the casket.

3. The invention according to claim 1 wherein the block includes a base and two opposed upstanding arms having camming surfaces defining a cavity therebetween for receiving the clamp and the caming surfaces cooperating in defining the tightening means.

4. The invention according to claim 1 wherein the clamp includes means for coupling with and supporting decorative hardware.

5. The invention according to claim 1 wherein the interior surfaces of the clamp include protrusions for cooperating with surfaces of the bar in securing the bar with the clamp.

6. The invention according to claim 1 wherein the clamp is provided with split overlapping ends.

7. The invention according to claim 1 wherein the overlapping ends of the clamp and the base of the block are provided with aligned holes, and the coupling means includes a threaded bolt extending through the aligned holes and adopted to extend through a hole in the casket side wall and a nut threadedly received on the bolt.

8. A casket having a base, top, ends and opposed sides, a stationary bar on each of the apposed sides, and at least two spaced stationary bar hardware systems coupling each bar to the associated casket side, each stationary bar hardware system comprising in combination:

a block for attachment to the side of a casket; a clamp having an opening for receiving a bar; coupling means for coupling upon actuation the clamp to the block and the block in turn to the side of a casket; and the clamp and block providing tightening means defined by interranging surfaces of the clamp and block to tighten the clamp above the bar upon actuation of the coupling means.

9. The invention in accordance with claim 8 wherein the block, clamp and coupling means cooperate in providing the complete support for the bar which is accordingly able to bear the weight of the casket.

10. The invention according to claim 8 wherein the block includes a base and two opposed upstanding arms having camming surfaces defining a cavity therebetween for receiving the clamp and the caming surfaces cooperating in defining the tightening means.

11. The invention according to claim 8 wherein the clamp includes means for coupling with and supporting decorative hardware.

12. The invention according to claim 8 wherein the interior surfaces of the clamp include protrusions for cooperating with surfaces of the bar in securing the bar with the clamp.

13. The invention according to claim 8 wherein the clamp is provided with split overlapping ends.

14. The invention according to claim 8 wherein the overlapping ends of the clamp and the base of the block are provided with aligned holes, and the coupling means includes a threaded bolt extending through the aligned holes and adopted to extend through a hole in the casket side wall and a nut threadedly received on the bolt.

15. The invention in accordance with claim 8 wherein decorative hardware free from bearing any of the weight of the casket when the bars are lifted are associated with each stationary bars hardware system and at each corner of the casket and extending over the associated end of the bar.

* * * * *